United States Patent [19]

Miller

[11] B 3,982,641

[45] Sept. 28, 1976

[54] HOPPER CAR DOOR ACTUATING MECHANISM

[75] Inventor: Roy W. Miller, Highland, Ind.

[73] Assignee: Pullman Incorporated, Chicago, Ill.

[22] Filed: Mar. 6, 1975

[21] Appl. No.: 555,772

[44] Published under the second Trial Voluntary Protest Program on January 13, 1976 as document No. B 555,772.

[52] U.S. Cl. ..... 214/58; 105/241 C

[51] Int. Cl.[2] ..... B65G 67/24

[58] Field of Search ..... 214/58, 63; 105/241 C

[56] References Cited

UNITED STATES PATENTS 3,314,558 4/1967 Dorey ..... 214/63

3,459,317 8/1969 Shaver ..... 214/63

*Primary Examiner*—Robert G. Sheridan

*Attorney, Agent, or Firm*—Richard J. Myers

[57] ABSTRACT

A door actuating mechanism for hopper cars includes a pivoted lever moved in response to a cam situated along the track on which a railway car travels. In order to provide for proper door opening under all conditions, a secondary cam is also provided which is engaged by a cam follower which provides a positive laterally directed force for pulling the lever and the door to its open position.

8 Claims, 4 Drawing Figures

HOPPER CAR DOOR ACTUATING MECHANISM

CROSS-REFERENCE TO RELATED APPLICATIONS

A related application is Ser. No. 591,190 filed June 27, 1975.

BACKGROUND OF THE INVENTION

1. Field of the Invention

The present invention relates to a door actuating mechanism for opening and closing the bottom discharge doors of a railway hopper car. More particularly, the present invention relates to an improved camming device which is positioned adjacent the railroad track and which actuates the door operating mechanism.

2. Description of the Prior Art

In the prior art, U.S. Pat. Nos. 1,266,630 May 21, 1918; 1,803,384 May 5, 1931; 3,314,558 Apr. 18, 1967; and 3,459,317 Aug. 5, 1969 show representative designs wherein door actuating mechanisms are operated from off track devices. The present invention is an improvement over such door operating mechanisms.

SUMMARY OF THE INVENTION

The present invention is concerned with bottom discharge doors for hopper cars which may transport coal and other materials to a site wherein the bottom doors are then opened to discharge materials through the rail structures into suitable bins. The invention includes cams disposed on opposite sides of the railway track for opening and for closing the doors after the discharge has been completed. The present invention is primarily concerned with the design of the opening cams which include an auxiliary positive opening cam in addition to the normally operating cam which functions to actuate the door opening mechanism.

In the present design, the hopper doors are initially opened by means of a bell-shaped crank arm or lever which is pivoted on a bracket structure and which includes a cam follower adapted to engage an opening cam for pivoting the lever to an over-center position. The lever is inititally moved slightly from its over-center position and the material within the railway hopper car by gravity forces the door open further and thus the material is discharged. A positive auxiliary cam is included in the present design which guarantees opening of the door should the doors be opened without the presence of a load within the hopper car. This might be the case wherein the doors have to be opened for cleaning out debris from an essentially empty car. If the doors are frozen because of ice or other conditions, the initial opening cam may be insufficient in force to crack the doors open in view of the absence of a load forcing the doors downwardly by the weight of the material. In cases of this type, the auxiliary or positive opening cam would be placed in position and by its engagement with a hook-shaped cam follower provided at the lower end of the bell crank lever, the doors would be positively opened as the hook-shaped lever moves along the inner surface of the auxiliary cam.

DESCRIPTION OF THE PREFERRED EMBODIMENT

Figure 1:
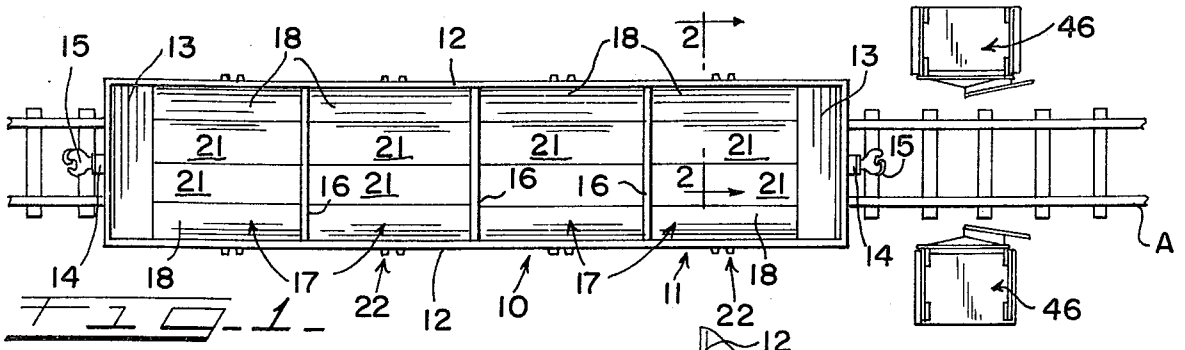
FIG. 1 is a planned view of a railway hopper car movable along the track into position for discharging materials.
Figure 2:
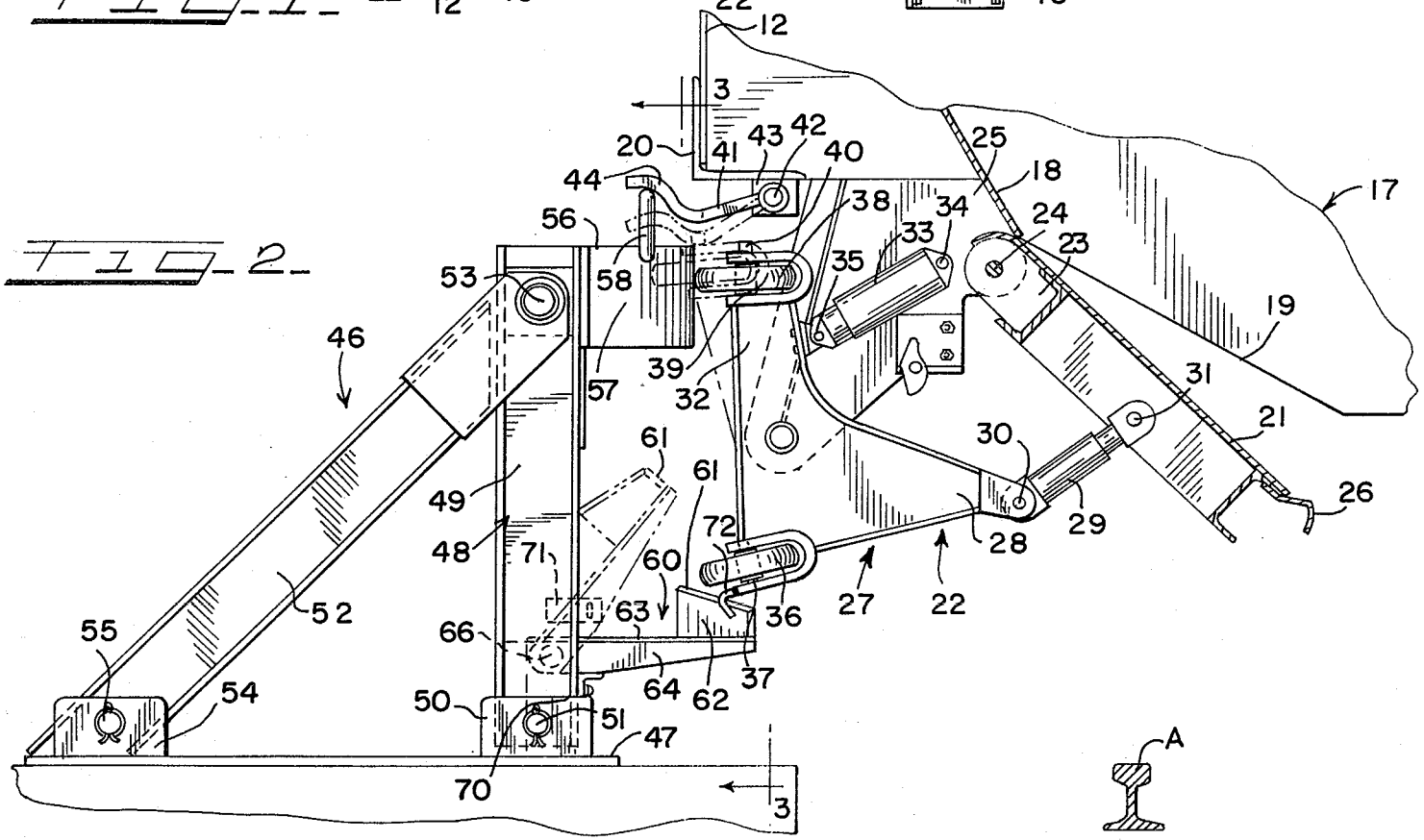
FIG. 2 is a cross-sectional view taken substantially along the line 2—2 of FIG. 1.

Referring particularly to FIG. 1, a railway hopper car is designated by the reference character 10 and includes a body 11 having sidewalls 12. The body 11 also includes downwardly and inwardly sloping endwalls 13. An underframe center sill 14 is suitably supported on bolster and truck structures not shown, but of conventional design. Car couplers 15 project outwardly from opposite ends of the underframe sill 14. The railway hopper car 10 is adapted to be positioned for movement along the track A. As best shown in FIG. 1, separator walls 16 provide for a plurality of hopper structures 17 on the car 10. The hopper structures each include inwardly sloping hopper walls 18, as best shown in FIG. 2, which at their lower ends forms a discharge opening 19 through which materials may be discharged. The body also includes conventional longitudinally extending side sills 20.

The discharge opening 19 is adapted to be opened and closed by means of hopper doors 21 which are regulated by a door actuating mechanism generally designated at 22. Each of the doors 21 is suitably connected by means of pivot members 24 and hinge brackets 23 to a bracket structure 25 positioned outwardly of the hoppers on the body 11. The leading edge of the hopper doors are also provided with suitable edge seals 26 which, during the closed position, form a tight and effective seal to prevent the escape of materials within the hopper.

The door actuating mechanism 22 includes a bell crank lever 27 for each door 21, which in the operation of this type of door opening mechanism is more specifically described in Patent application Ser. No. 415,098 filed Nov. 12, 1973, now U.S. Pat. No. 3,872,796.

Each bell crank lever 27 includes a laterally extending arm 28 which is connected by pivot means 30 to a link 29 in turn connected by pivot means 31 to each of the doors 21. The bell crank lever 27 also includes an upright arm 32 which is connected to a spring actuated link element 33, more specifically described in the aforementioned application. The element 33 is pivotally connected at 34 to the brackets 25 and is connected by means of a pivot pin 35 to the upright arm 32. The lower end of the upright arm 32 is provided with a roller structure or cam follower 36 suitably pivoted on a shaft 37. Similarly, the upper end of the upright arm is also provided with a roller structure 38 or cam follower pivotally positioned thereon by means of a shaft 39. The upright arm 32 also is provided at its upper end with a lock projection 40 which is adapted to be engaged by an auxiliary lock and latch 41 pivoted as indicated at 42 to a bracket 43 in turn supported on the body 11. The auxiliary lock or latch 41 includes a curve-end plate portion 44 having a V-shaped notch 45. This structure is more clearly defined and forms a part of the first mentioned related patent application.

The cam structure is generally designated at 46. As best shown in FIG. 1, the cam structures 46 are positioned on opposite sides of the railway track A to be engaged by portions of the door actuating mechanisms of the railway hopper car. Each cam structure 46 includes a base 47 having an upright pedestal 48 formed by a pair of horizontally spaced upright legs 49. Brackets 50 connect the upright legs 49 to the base 47 and removable pivot pins 51 are provided for connecting the lower ends of the legs to the brackets 50. The upright legs 49 are maintained in position by means of diagonal braces 52 which by means of pivot pins 53 are removably connected to the upper ends of the upright legs 49. Brackets 54 are connected to the base 47 and are removably connected to the lower ends of the diagonals 52 by means of removable pins 55.

Figure 4:
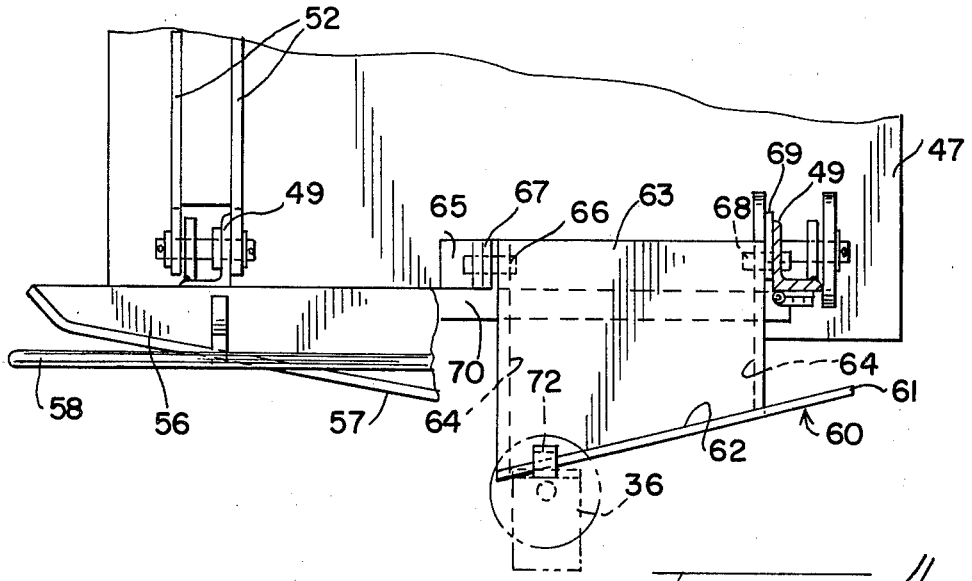
FIG. 4 is an elevational partly cross-sectional view taken substantially along the line 4—4 of FIG. 3.

A horizontal cam 56 is supported at the upper end of the pedestal and includes a cam face 57 which slopes diagonally outwardly to an apex and then slopes diagonally inwardly, as best shown in FIGS. 1 and 4. A latch disengaging rod 58 is positioned above the cam 56 by means of brackets 59 suitably supported on the cam 56.

Figure 3:
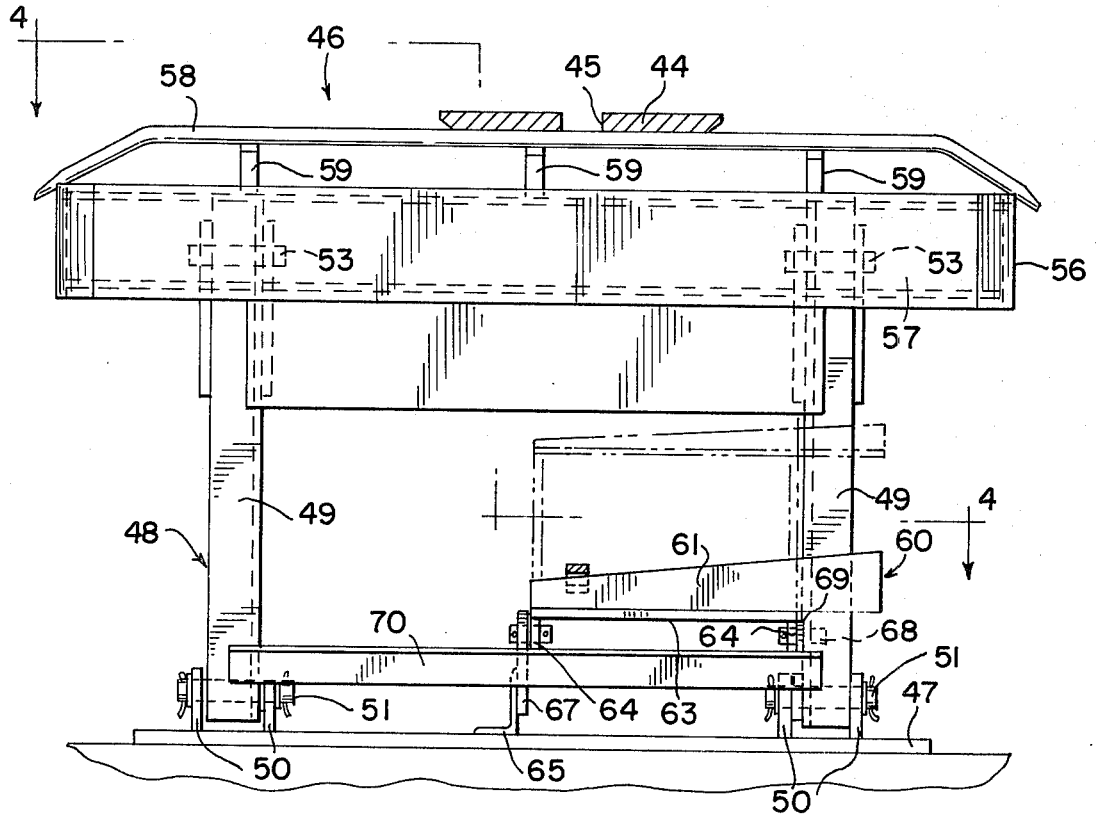
FIG. 3 is a side elevational view of an improved camming structure positioned adjacent a railway track taken substantially along line 3—3 of FIG. 2.

A secondary positive opening cam is designated at 60 and is positioned below the cam 56. The positive opening cam 60 includes a diagonal cam plate 61 having an inner cam face 62. The cam face 62 extends approximately from the apex of the cam face 57 diagonally inwardly, as indicated in FIG. 4. The cam 60 includes a bottom plate 63 provided with downwardly extending flange members 64. An angle bracket 65, as best shown in FIGS. 3 and 4, is positioned on one side of the cam 60 on the base 47. A pivot pin 66 extends through the angle bracket 65 and through an upstanding plate 67 secured to the angle bracket 65, the said pin also extending through one of the flange members 64 to provide for pivotal or hinging movement. An aligned pivot pin 68 extends through the other of the flange members 64 and through a spacer plate 69 supported on one of the upright legs 49 the said pivot pin 68 also being supported on said upright leg 49. The pivot pins 66 and 68 permit the cam 60 to be hingedly moved from a use to a non-use position as desired. A cross angle member 70 is fixed to the lower ends of the uprights 49 and projects outwardly with respect thereto. As best shown in FIG. 2, the angle member 70 provides for supporting the cam 60 in operative position as shown. As shown in FIG. 2, a suitable bracket 71 is supported on one of the uprights 49 and may include locking means not shown for maintaining the cam 60 in a non-use position. As shown in FIGS. 2 and 4, the lower follower provided by the roller structure 36 also includes an outwardly and downwardly hook type camming follower 72 which is adapted to engage the inner camming surface 62 of the cam 60, as indicated in FIGS. 2 and 4.

THE OPERATION

The operation of the bell crank lever 27 and auxiliary lock or latch 41 in connection with the opening cam is more specifically described in the aforementioned patent applications. Briefly, as the railway car is moving along the track, as shown in FIG. 1, toward the camming structures 46, the latch engaging rod 58 moves the latch 41 uupwardly thereby disengaging the V-shaped notch 45 from engagement with the latch projection 40 so that the lever 27 may now be pivoted from an over-center position to the positions shown in FIG. 2. The pivoting of the lever 27 is achieved by an engagement of the roller 38 with the upper cam face 57 which cracks open the door 21 whereupon the load within the car pushes the doors further to a completely open position. During the normal operation, the auxiliary or positive opening cam 60 may be in the dotted line out-of-the-way position shown in FIG. 2. In normal operation opening is achieved since the load within the car is sufficiently heavy to immediately exert a positive opening force on the doors to move them downwardly after the door has been cracked open and the arm 28 and link 29 moved to the out of the over-center position.

In certain instances, such as in the winter time, empty cars may gather residue, snow, etc. and have to be cleaned out when they arrive at their loading points. In order to clean out the cars, it is necessary to provide a positive opening cam which will pull the doors open since there is insufficient weight inside on the doors to force them to the completely opened position. Thus, the present opening cam includes the additional positive camming device 60, which is disclosed in FIGS. 2, 3 and 4. When it is desired to provide for positive opening of the doors, which may be frozen in position, in order to clean out the car or to break the doors free of ice, the positive opening cam 60 is placed in the horizontal position, shown in FIGS. 2 and 4. Thus, as the car moves toward the cam structures 46, the follower 38 functions to exert a force to pivot the bell crank lever 27 clockwise, as shown in FIG. 2, but by this means the doors may not be completely open end as desired. At this point, the hook follower 72 engages the inner camming surface 62 of the cam, as shown in FIG. 2, and as it moves along the inclined face a further outwardly pulling force is exerted at the lower end of the upright arm 32, thus further moving the arm 27 to completely open the door in the same manner as would be the case if the car were fully loaded and the load would be discharged. When it is desired to only utilize the regular cam structure on cars which are fully loaded, it is of course a simple matter to place the auxiliary cam 60 in the out-of-the-way position, as shown in FIG. 2.

What is claimed is:

1. For a railway hopper car having a body structure and a hopper, bottom door dump means for discharging material from said hopper in an open position, door actuating mechanism for moving said door between open and closed positions including a bell shaped crank arm pivotally mounted on said structure and having an arm position pivotally connected to said door, cam follower means on said arm, the improvement comprising;

a cam structure positioned adjacent a railway track on which said car is travelling, said structure including a base having an upright pedestal, a horizontal cam member supported on said pedestal and including a vertical cam surface, said cam follower means during movement of said car engaging said vertical cam surface whereby said arm is pivotally moved and said door is opened, a second auxiliary cam supported on said pedestal, and including a second vertical cam surface and second follower means on said arm engaging said second cam during engagement between said first cam follower and said first cam whereby an additional force is initiated to pivot said arm to said open position of said door means.

2. The invention in accordance with claim 1, said engagement between said first follower means and said cam providing an inwardly directed pushing force to pivot said arm, and said engagement between said second follower means and said second cam providing an outwardly directed pulling force to pivot said arm in said open position of said door means.

3. The invention in accordance with claim 2, said second cam having a vertical generally longitudinal second cam surface and said second follower including a hook-shaped end portion engaging said second cam surface which is disposed in facing relative to said pedestal.

4. The invention in accordance with claim 1, said first cam surface having a V-shaped configuration facing said arm with the apex of said V-shaped configuration of said cam surface being disposed closest to said arm relative to the remainder of said surface, and said second cam surface of said second cam facing said pedestal in an opposite direction than said first cam surface and being substantially parallel to said first cam surface, said arm including a hook-shaped cam follower engaging said second cam surface.

5. The invention in accordance with claim 1, said auxiliary cam being movable to a non-use position.

6. The invention in accordance with claim 4, said auxiliary cam being pivotally converted to said pedestal for movement to an out-of-the-way position.

7. The invention in accordance with claim 1, said first vertical cam surface being V-shaped in plan view to provide an inwardly inclined surface and an outwardly inclined surface from the apex of said V-shaped configuration, said auxiliary cam having its second vertical cam surfaces disposed substantially parallel to said outwardly inclined surface.

8. The invention in accordance with claim 7, said second vertical cam surface beginning at the apex of said first cam surface and being coextensive with said outwardly inclined surface.

* * * * *